United States Patent [19]

Irwin

[11] 4,395,791

[45] Aug. 2, 1983

[54] SPRING FEEDING MECHANISM

[76] Inventor: Lawrence F. Irwin, 12860 San Fernando Rd., Sylmar, Calif. 91342

[21] Appl. No.: 247,802

[22] Filed: Mar. 26, 1981

Related U.S. Application Data

[63] Continuation-in-part of Ser. No. 126,210, Mar. 3, 1980, abandoned.

[51] Int. Cl.[3] ..... B08B 9/02

[52] U.S. Cl. ..... 15/104.3 SN; 226/25

[58] Field of Search ..... 15/104.3 R, 104.3 SN; 226/25, 52

[56] References Cited

U.S. PATENT DOCUMENTS

| | | | |
|---|---|---|---|
| 3,224,024 | 12/1965 | Hunt | 15/104.3 SN |
| 3,329,044 | 7/1967 | Singer | 15/104.3 SN X |
| 3,451,090 | 6/1969 | Lo Presti et al. | 15/104.3 SN |
| 3,882,565 | 5/1975 | Irwin et al. | 15/104.3 SN |
| 4,153,966 | 5/1979 | Irwin et al. | 15/104.3 SN |

FOREIGN PATENT DOCUMENTS

| | | | |
|---|---|---|---|
| 770079 | 3/1957 | United Kingdom | 15/104.3 SN |

*Primary Examiner*—Edward L. Roberts

[57] ABSTRACT

A spring feeding mechanism for use in conjunction with plumbing tools of the type used for cleaning and removing obstructions from drain pipes in which an elongated coiled spring wire, or plumber's snake, is advanced through the pipe and rotated. The feeding mechanism comprises hingeably interconnected jaw members adapted to carry rotatably mounted helically grooved feed rollers and includes a biasing means for yieldably urging the feed rollers into driving engagement with the snake. The feed rollers are readily removable from the jaws and are mounted at an angle with respect to the axis of the coil spring so that the grooves are substantially parallel with the coils of the spring. With this arrangement the rollers can be easily removed and replaced with rollers of different sizes. Due to the unique design of the biasing means the device can readily accommodate distortions and irregularities in the snake without damaging either the snake or the plumber's tool.

14 Claims, 13 Drawing Figures

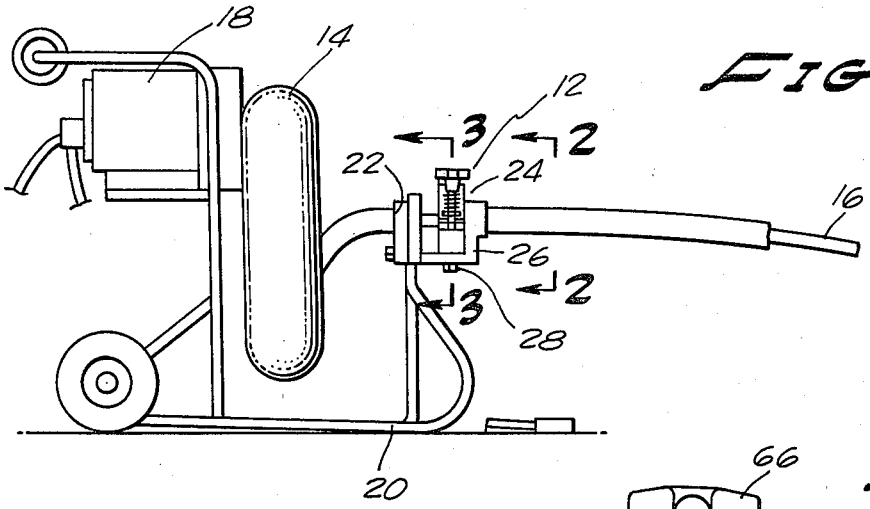
FIG. 1.
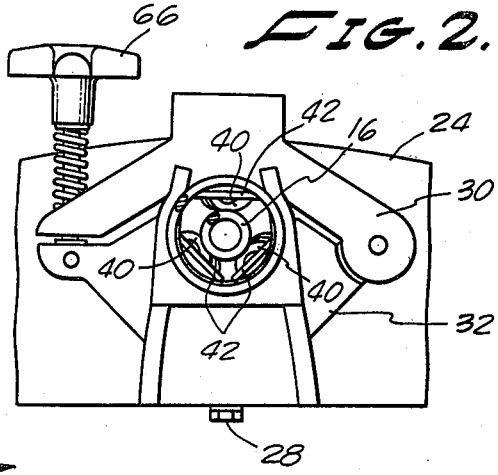
FIG. 2.
FIG. 3.
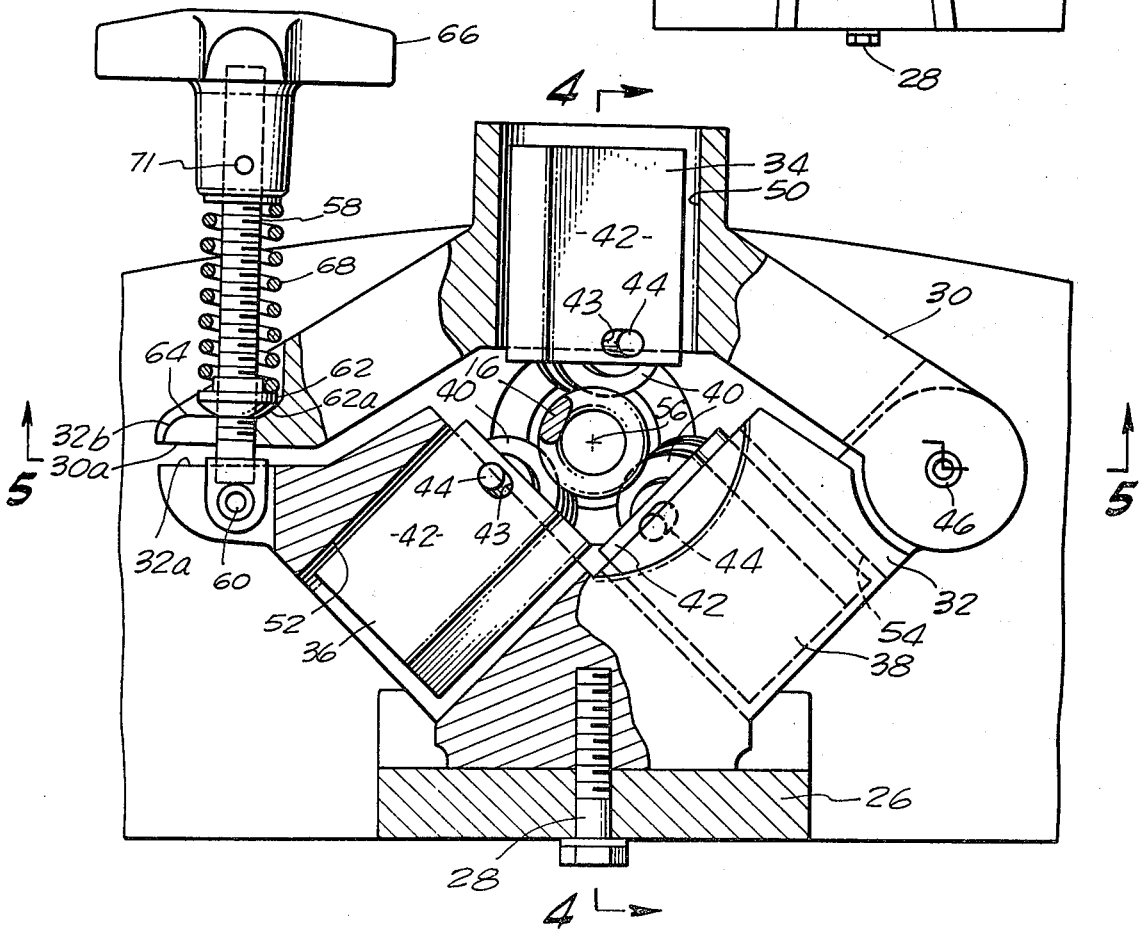

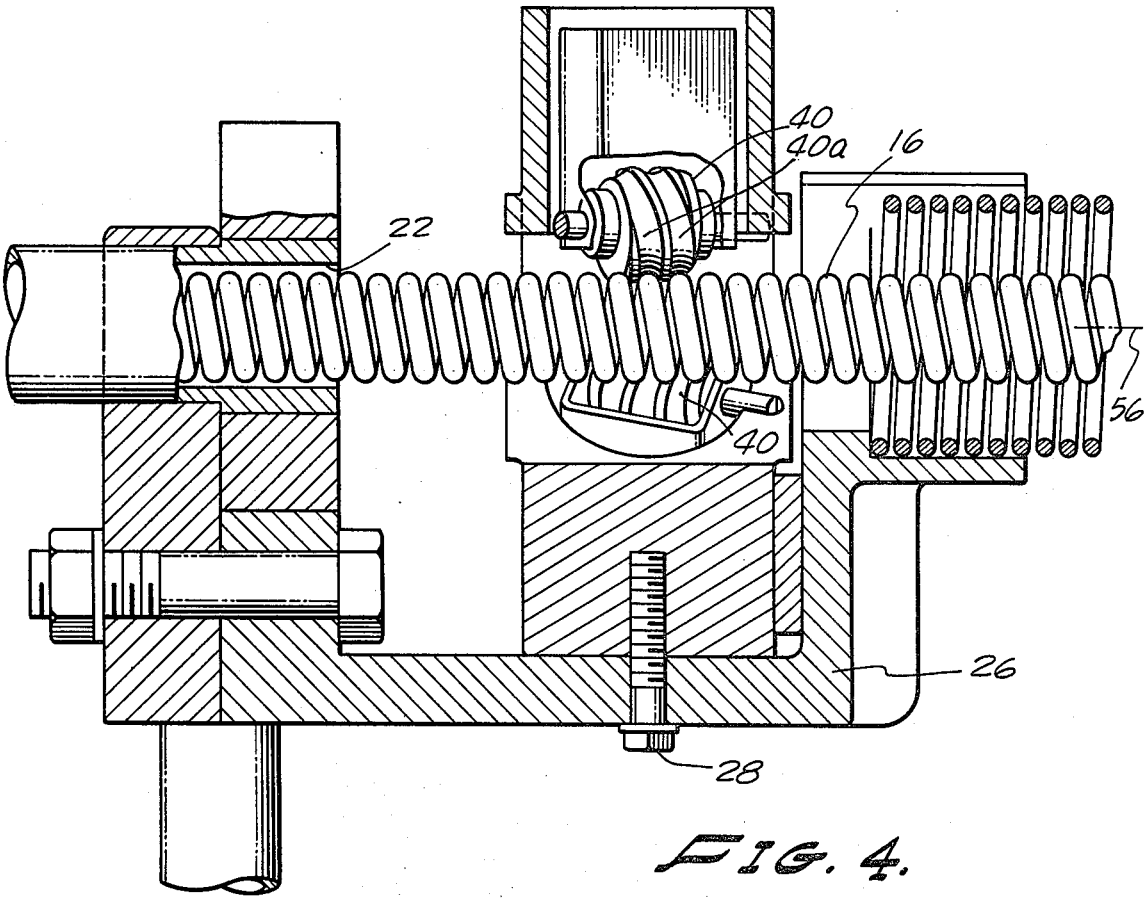
FIG. 4.
FIG. 5.
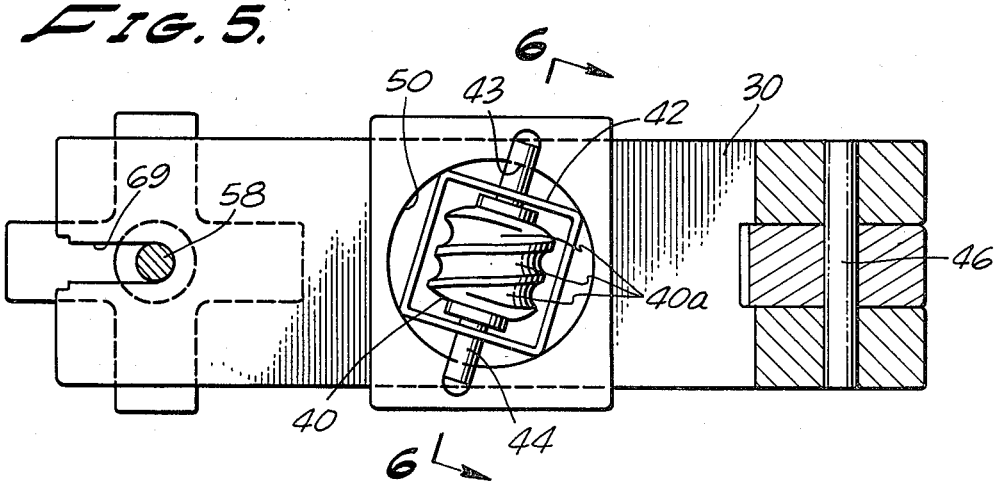

SPRING FEEDING MECHANISM

BACKGROUND OF THE INVENTION

This is a continuation-in-part application of co-pending application Ser. No. 126,210, filed Mar. 3, 1980, now abandoned.

FIELD OF THE INVENTION

The present invention relates generally to plumber's tools adapted for cleaning and removing obstructions from drain pipes and using an elongated member in the form of a coiled spring wire is advanced through the pipe and rotated. More particularly the invention relates to an improved spring feeding mechanism for use in connection with a plumber's tool embodying power means for rotating the snake.

DISCUSSION OF THE PRIOR ART

Spring-type plumber's snakes are ordinarily housed in a drum or container having a conoidal wall through which the spring or snake is fed and retracted axially of itself as the container is rotated to cause rotation of the spring. In conventional tools having power-operated spring advancing and retracting means, the feed mechanism typically includes a jaw in the form of segmented nut, or the like, through which the spring is fed by rotating it so that, in effect, the spring is threaded through the jaw. The stationary jaw cannot accommodate irregularities in the spring such as kinks, couplings and the like and if such irregularities are encountered, serious damage to the equipment can result. Also, should the spring or snake encounter a restriction within the pipe which it cannot immediately penetrate, the driving torque will build up against the stationary jaw causing the snake to kink and frequently break, thereby creating a significant safety hazard. Further, the portions of the jaw which engage and feed the spring are generally integrally formed with the jaw. Accordingly, when these portions become worn causing slippage of the snake, typically the entire jaw must be replaced.

Various attempts have been made in the past to design a feed mechanism which would overcome these drawbacks. Among the most successful of these prior art devices are the devices invented by Hunt, et al., and described in U.S. Pat. Nos. 2,769,191; 3,224,024; and 3,499,782. These devices, while clearly superior to similar units on the market, nevertheless have the drawback that the feed jaws cannot accommodate any appreciable distortion in the spring and the feed of the spring is controlled entirely by the operator. Unless the operator is continuously alert to any indication of impedance to forward feed of the spring within the pipe, and quickly responds by stopping the feed, the buildup of driving torque can cause serious damage to the equipment and possibly injure the operator as well.

Other highly successful devices adapted to uniformly feed the coiled spring and to accommodate for distortion and irregularity therein are described in U.S. Pat. Nos. 3,882,565 and 4,153,966 previously issued to the present inventor. The invention described and claimed herein comprises a simplified and improved version of the devices described in the aforementioned patents. One improvement concerns a novel simplification of the feed jaw design. Another relates to a simplified design of the biasing means. Still another concerns the "free floating" angular orientation of the feed rollers with respect to the axis of the spring.

Certain type of prior art devices have attempted to feed the snake by using smooth surface cooperating rollers set at an angle relative to the longitudinal axis of the snake. Such arrangements have proven troublesome in the field since significant downward pressure must be exerted on the spring by the rollers in order to positively feed the snake. However, if too much pressure is exerted the spring will bind. On the other hand, if too little pressure is exerted the spring will slip. In the present invention, helically grooved rollers are used and are set at an angle such that the grooves in the rollers are substantially parallel with the pitch of the coils in the spring. Additionally, some play is permitted in the rollers so that they can seek out and adjust precisely to the pitch of the spring. With this unique arrangement a minimum amount of pressure on the coiled spring by the rollers cause uniform feeding of the spring without binding or slippage.

SUMMARY OF THE INVENTION

It is an object of the present invention to provide a plumbing tool of the type employing an elongated coiled spring wire, or snake, which is rotated and fed into drain pipes and the like, in which there is provided a greatly simplified spring loaded feeding mechanism adapted, during the feed mode, to automatically adjust to the pitch of the spring and readily accommodate distortions and irregularities in the coiled spring without damaging either the coiled spring or the plumber's tool.

It is another object of the invention to provide a feeding mechanism as described in the preceeding paragraph in which helically grooved feed rollers are mounted at an angle with respect to the axis of the snake so that the grooves in the rollers are substantially parallel with the angle of the coils of the snake. In this regard it is a further object to provide a novel form of roller mounting means which permits the feed rollers to seek out the precise angular orientation which offers the minimum frictional drag on the rollers druing the feeding mode. In this way a minimum driving pressure is required and the life of the rollers is substantially increased.

It is another object of the invention to provide a feeding mechanism of the character described in which the feed rollers are readily removable for replacement in the field with rollers of different sizes and, or different lead.

It is still another object of the invention to provide a device of the class described in which the feed mechanism includes a simplified biasing mechanism for yeildably urging the feed rollers into driving engagement with the snake which is so constructed and arranged as to exert minimum pressure on the coiled spring and to permit the elements to accommodate distortions and irregularities in the snake and to move out of driving engagement with the snake in response to forces opposing feeding of the snake axially of itself.

It is a further object of the invention to provide a device as described in the preceeding paragraph in which the biasing mechanism is adjustable so that the force exerted thereby to hold the feed rollers in driving engagement with the snake may be controllably varied.

It is yet another object of the invention to provide a device of the class described in which the feed rollers are carried by hingeably interconnected jaws which are readily movable from a closed feeding mode into an open idling mode by means of a compact, highly simplified latching mechanism.

It is another object of the invention to provide a device as described in the preceeding paragraph in which the adjustable biasing means is embodied into the compact latching mechanism for ease and safety of operation and simplicity of design. With this construction, no lever arms or gripping mechanisms extend laterally from the tool thereby minimizing possible injury to the operator and damage to the tool.

It is still a further object of the invention to produce a novel, low-cost, lightweight feed mechanism which is simple to operate and can be readily attached to both hand held and wheel mounted tools presently on the market. In this connection it is an object to provide such a means which can be readily engaged or disengaged by the operator with very little effort and without any particular skill.

These and other objects will be apparent from the drawings and the following description.

BRIEF DESCRIPTION OF THE DRAWINGS

FIG. 1 is a side elevational view of the spring feeding mechanism of the present invention as it appears when affixed to a wheel mounted power driven sewer clean out apparatus.

FIG. 2 is an enlarged fragmentary view taken along lines 2—2 of FIG. 1 showing a front view of the spring feeding mechanism of the invention.

FIG. 3 is a greatly enlarged cross-sectional view taken along lines 3—3 of FIG. 1 showing the internal construction of the spring feeding mechanism of the invention.

FIG. 4 is a cross-sectional view taken along lines 4—4 of FIG. 3.

FIG. 5 is a cross-sectional view taken along lines 5—5 of FIG. 3.

FIG. 9 is a fragmentary view similar to FIG. 2 showing another embodiment of the feeding mechanism of the invention.

FIG. 10 is an enlarged fragmentary view, partly in section, of the feed adjustment portion of the mechanism shown in FIG. 9.

FIG. 11 is a cross-sectional view taken along lines 11—11 of FIG. 10.

FIG. 12 is a view similar to FIG. 10 showing the configuration of the device when the feed lever has been fully depressed to achieve a maximum rate of feed of the coiled spring.

FIG. 13 is a view similar to FIG. 9 but showing the spring feed mechanism in an open position.

DESCRIPTION OF THE INVENTION

Figure 6:
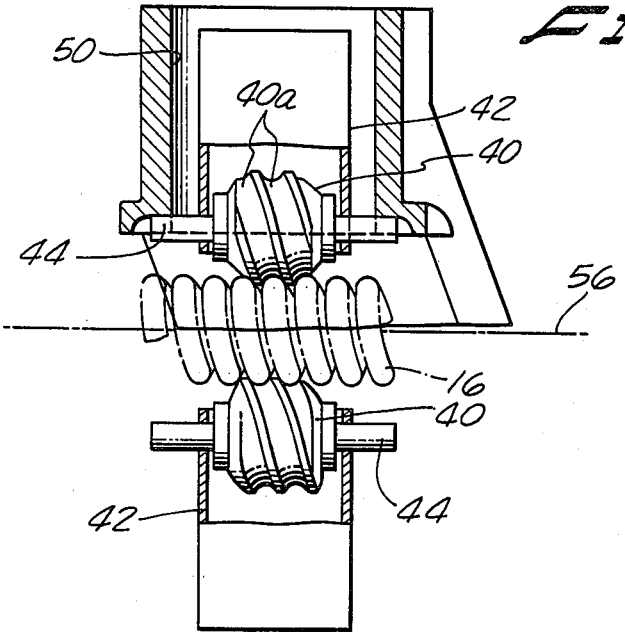
FIG. 6 is a cross-sectional view taken along lines 6—6 of FIG. 5, the lower half of FIG. 6 depicting the position of the lower jaw of the feeding mechanism relative to the coil spring.

Referring to the drawings, FIG. 1 shows one type of sewer clean out apparatus embodying the feeding mechanism of the present invention which is generally designated by the numeral 12. The apparatus includes a snake housing 14 adapted to house a coiled plumber's snake 16 shown here as a tightly coiled spring wire or cable. The housing 14 has mounted thereon a reversible electric motor 18 which is used for rotating the housing and the coiled spring or snake encased therein either in a clockwise or counterclockwise direction. In the type of apparatus shown in FIG. 1, the housing and the motor are mounted on a wheeled cart 20 for ease of transport and are interconnected in a conventional manner to permit controlled rotation of the housing. Snake housing 14 is provided with an opening 22 which is concentric with the axis of rotation of the housing and through which the rotating coiled spring 16 may be fed.

The snake feeding mechanism 12 of the embodiment of the invention shown in the drawings is located forwardly of the snake housing and, as also shown in FIG. 3, is affixed to bracket 26 on cart 20 by means of a threaded stud 28.

Turning now particularly to FIGS. 2, 3 and 4, the feeding mechanism of the invention comprises snake engaging means movable into and out of driving engagement with the snake for feeding the snake axially of itself. In the instant form of the invention, the snake engaging means include first and second hingeably interconnected jaws 30 and 32, a first feed roller assembly 34 removably carried by jaw 30, and second and third roller assemblies 36 and 38 removably carried by jaw 32. Each feed roller assembly comprises a helically grooved roller 40, a housing 42 adapted to rotatably house each said roller and an axle 44 supported within housing 42. Axle 44 functions to rotatably support the roller 40 for rotation about an axis disposed at an angle with respect to the longitudinal axis of the snake. As will be discussed more fully hereinafter, the feed roller assemblies thus described comprise roller positioning means for positioning the rollers within the jaws in a precise orientation with respect to the plumber's snake.

Figure 7:
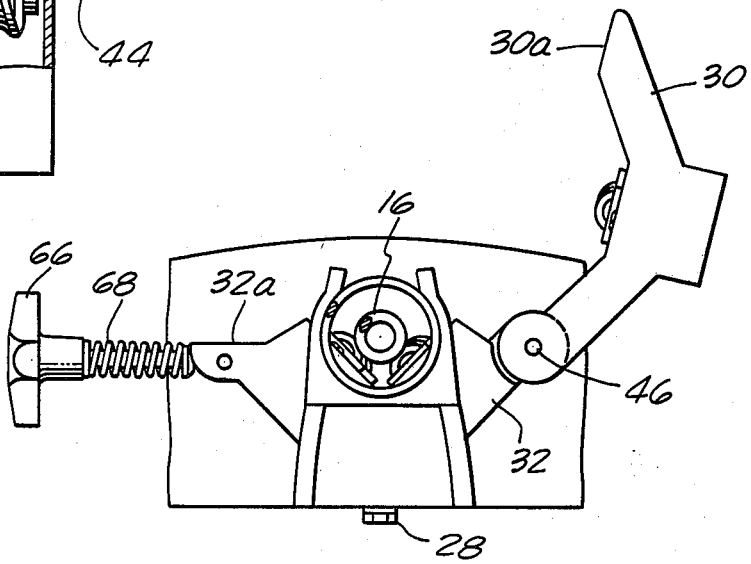
FIG. 7 is a view similar to FIG. 2 but showing the spring feeding mechanism in an open position.

Referring to FIG. 7, the first and second hingeably interconnected jaws 30 and 32 are movable from a first open position as there illustrated into a second closed position proximate the snake as illustrated in FIGS. 2 and 3. As best seen by referring to FIGS. 3 and 5, the first and second jaws 30 and 32 are hingeably connected at one end by a hinge pin 46. At their free ends, each jaw is provided with mating portions **30*a* and 32*a* which are movable into close proximity when the mechanism is in the closed position illustrated in FIG. 3. As indicated in FIGS. 3 and 5, the mating portions of jaws 30 and 32** are slotted to accommodate the latching means of the invention, the construction and operation of which will presently be described.

In addition to being slotted at its free end, jaw 30 is also provided with a recessed opening, or bore 50 (see also FIG. 5) adapted to closely receive one of the roller assemblies 42. Similarly jaw 32 is provided with a pair of spaced apart angularly inclined recessed openings or bores 52 and 54 each of which is also adapted to closely receive one of the roller assemblies 42.

As best seen in FIG. 5, each housing 42 is rectangular in cross-section and is adapted to be closely received within the bores formed in the jaws. The relative sizes of the housings and of the bores is such that the angle of the axis of rotation of the axle 44 is maintained in a precise orientation with respect to the longitudinal axis 56 of the snake 16. It is to be understood, however, that the housings 42 and the openings in which they are received can be constructed in various configurations to accomplish the purpose of properly angularly orienting the axles 44.

Turning to FIGS. 4 and 6, it can be seen that when the jaws 30 and 32 are in their closed position, the helically grooved rollers 40 which have the same pitch as the coils of the snake are brought into close proximity with the snake or spring 16. More particularly it is to be noticed that because of the angular orientation of the axis of rotation of the rollers, the helical grooves therein are very closely aligned with the angular orientation of the coils of the coiled spring or snake 16. Due to wear and deformation of the snake during use, however, the angular orientation and pitch of the coils does not remain absolutely constant. Accordingly, an important feature of the mechanism of the present invention resides in the fact that during operation of the apparatus the rollers 40 can adjust to precisely accommodate variances in orientation of the coils of the snake as the snake passes longitudinally between the rollers. This automatic adjustment feature is accomplished by constructing the axle bearing surfaces of the roller assemblies such that each axle member 44 can move slightly within the housing 42 as the snake is fed longitudinally of the mechanism. The most straight forward way to provide this limited degree of movement of the axle member is to form aligned apertures 43 in the side walls of housing 42 through which the axle 40 extends slightly larger in diameter than the diameter of the axle. An appropriate degree of angular play in the rollers can, of course, also be achieved by more sophisticated means such as the use of roller bearings having a predetermined amount of clearance between the bearings and the race.

With the construction shown in the drawings, each roller 40 is freely rotatable in either direction about the axis of axles 44 so that the snake can be fed forwardly or retracted. If it is desired to increase or decrease the rate of reed or retraction of the snake through the mechanism, the lead of the helical grooves of the feed rollers may be increased or decreased to provide the desired coil advance.

Also forming a part of the feeding mechanism of the present invention is a latching means for moving the first and second jaws from a first open position as shown in FIG. 7, to a second closed position as shown in FIG. 3 and for latching the jaws together in the second closed position. In the embodiment of the invention shown in the drawings the latching means also includes biasing means for yieldably urging against separation of the jaws when they are in their closed position. As will be discussed in greater detail in the paragraphs which follow, the biasing means also performs the unique function of being responsive to forces opposing axial feeding of the snake so that the feed rollers 40 will automatically move out of driving engagement with the snake in response to such forces.

Referring particularly to FIGS. 2, 3 and 7, the latching means of the present embodiment of the invention can be seen to comprise an elongated member 58 which is pivotally connected by means of a hinge pin 60 to second jaw 32; engaging means, shown here as a collar 62 adapted to lockably engage a flat surface 64 provided on jaw 30 (FIG. 3); and adjustment means carried by member 58 for adjusting force exerted by the biasing means tending to urge against separation of the jaws 30 and 32. Collar 62 is annular in shape and is closely receivable over and axially movable with respect to member 58. In the present form of the invention, the adjustment means comprises a handle member 66 threadably connected proximate the free end of member 58 and the biasing means comprises a coil spring 68 disposed intermediate collar 62 and handle member 66.

OPERATION

In operation of the embodiment of the invention shown in FIGS. 1 through 7, jaw 30 is first moved from the open position shown in FIG. 7 to the closed position shown in FIG. 3. Next, by gripping handle 66, member 58 can be pivoted from the generally horizontal position shown in FIG. 7 into the substantially vertical position shown in FIG. 3. As the assembly nears the vertical position, the curved lower periphery **62*a* of collar 62 will engage the curved surface 32*b* formed proximate the free end of the jaw 30. Continued movement of member 58 toward a vertical position will result in the member 58 moving into the slot 69 formed in the free end of jaw 30 (FIG. 5). At the same time the coiled spring 68 will compress slightly due to the upward movement of collar 62**.

With the mechanism oriented in the manner illustrated in FIG. 3, the helically grooved rollers 40 have been moved into close proximity with the snake 16. To bring rollers 40 into snug engagement with the snake 16, handle 66, which is threadably connected to member 58, is rotated in a clockwise direction to compress spring 68 between the top of collar 62 and the bottom of handle 66. Pin 71 acts as a stop to limit the extent of travel of this handle onto member 58. As previously discussed, any variance between the angle of the grooves in the rollers and the angle generated by the coils of the spring will be accommodated by a limited angular movement of the rollers within their housing 42. To commence feeding of the snake, motor 18 is connected with a source of electrical power and energized by either a manual switch on the motor or by stepping on a remote foot switch. Energization of the motor causes drum 14 and snake 16 to rotate. This in turn causes rotation of the feed rollers 40 in an opposite direction and, assuming proper tension on spring 68, results in the axial advance of the snake 16. Retraction of the snake is accomplished by reversing the direction of rotation of the motor. As the snake is fed into the clogged pipe, the force exerted on the snake by the drive rollers can be varied as desired by rotation of handle 66 to increase or decrease the force exerted by spring 68 tending to resist separation of the jaws 30 and 32. As previously mentioned, if an obstruction is encountered in the pipe which resists further feeding of the snake, the tension on spring 68 is such that the feed rollers can automatically separate slightly and move out of driving engagement with the snake. This prevents damage to the snake and more importantly guards against injury to the operator.

Figure 8:
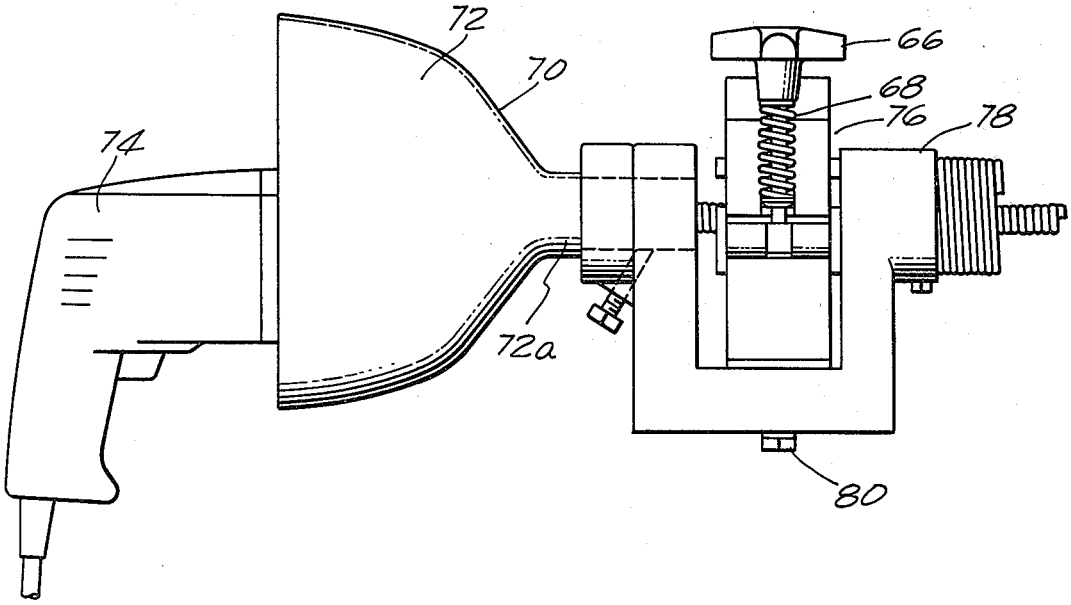
FIG. 8 is a side elevational view showing the spring feeding mechanism of the invention affixed to a hand held power sewer clean out apparatus.

Referring to FIG. 8, there is shown another form of apparatus of the invention adapted for use in connection with a hand held plumber's tool generally designated by the numeral 70. Apparatus 70 comprises a snake housing 72 in which the plumber's snake 16 is coiled. Housing 72 is mounted on and rotated by a hand held drill motor 74. The feeding mechanism of this form of the invention generally designated by the numeral 76 is provided with a mounting collar 78 adapted to be closely received over the axially extending neck portion **72*a* of housing 72. The device is held securely in position by a locking set screw of bolt 80. The feeding mechanism 76 is of identical construction and assembly as previously described herein. The elements of the feeding mechanism interact to feed the snake 16** in the same manner as the elements of the embodiment first described and such description will not be repeated herein.

In using the feeding mechanism with either of the types of apparatus shown in FIGS. 1 and 8, the feed roller assemblies can be quickly and easily removed and replaced by simply moving the jaws into an open position and lifting the feed roller assemblies from the openings in the jaws. The construction of the mechanism is such that roller assemblies embodying larger or smaller rollers can easily be substituted in the field without the need for special tools. Similarly, roller assemblies carrying rollers with varying lead can be substituted so as to feed the snake at faster or slower rates. In all cases, the design of the unit is such that the rollers can move so that the grooves are in precise parallelism with the coils of the snake thereby significantly reducing friction and wear.

Turning now to FIGS. 9 through 13, still another embodiment of the invention is illustrated. This embodiment is similar in operation and configuration to that shown in FIGS. 1 through 7 and in FIGS. 9 through 13 like numerals will be used to identify like parts. A unique aspect of the form of the invention shown in these Figures comprises an important speed control, quick release safety feature. This feature permits precise regulation of the rate of feed of the snake and at the same time allows for immediate reduction in the feed rate should a restriction in the line be encountered.

As best seen in FIGS. 9 and 10, the differing feature of this embodiment involves the latching means of the invention for latching the jaws 30 and 32 together. More particularly the design of the latching means has been modified to provide an actuating lever assembly 90 in place of the rotatable handle member 66. Lever assembly 90 comprises an elongated handle portion **90*a* having a pair of spaced apart downwardly depending integral side walls 90*b* (FIG. 11) which are curved to define cam-like surfaces 90*c*. Cam surfaces 90*c* are adapted to engage the upper surface of an upper collar 92 which is closely receivable over an elongated member 94. Member 94 is externally threaded proximate its upper end and is pivotally connected proximate its lower end to second jaw 32 by means of a hinge pin 96. Disposed intermediate the side walls 90*b* of the actuating lever assembly 90 is a drum shaped member 98 (FIGS. 10 and 11) having an internally threaded bore 100 adapted to threadably receive proximate its upper end a set screw 102 and proximate its lower end elongated member 94. Member 98 is held in position between side walls 90*b* of the lever handle by a pair of axially aligned, oppositely disposed fasteners 104 which extend through the side walls 90*b* and are threadably received within axially extending internally threaded bores 106 provided in drum member 98 (FIG. 11**).

A lower collar 108 is receivable over member 98 and is adapted to lockably engage the previously identified flat surface 64 provided on jaw 30. Disposed intermediate upper and lower collars 92 and 108 is a biasing means tending to urge against separation of the jaws 30 and 32. In this embodiment of the invention the biasing means is provided in the form of a coil spring 110 the upper end of which engages collar 98 and the lower end of which engages collar 108. A second coil spring 112 is disposed between jaw 32 and the lower surface of collar 108 and functions to continuously urge collar 108 into engagement with coil spring 110.

In operation of the embodiment of the invention shown in FIGS. 9 through 13, jaw 30 is first moved from the open position shown in FIG. 13 to the closed position shown in FIG. 9. Next, by the actuating lever assembly 90, member 94 can be pivoted from the generally horizontal position shown in FIG. 13 into the substantially vertical position shown in FIG. 9. As the assembly nears the vertical position, the curved lower periphery **108*a* of collar 108 will engage the curved surface 32*b* formed proximate the free end of jaw 30. Continued movement of member 94 toward a vertical position will result in the member 94 moving into the slot 69 formed in the free end of jaw 30 (FIG. 5). At the same time the coiled spring 110 will compress slightly due to the upward movement of collar 108**.

With the mechanism oriented in the manner illustrated in FIG. 9, the helically grooved rollers 40 have been moved into close proximity with the snake 16. To bring rollers 40 into initial contact with the snake 16, lever assembly handle **90*a* is rotated in a clockwise direction to compress spring 110 between the top of collar 108 and the bottom of collar 92. As previously discussed, any variance between the angle of the grooves in the rollers and the angle generated by the coils of the spring will be accommodated by a limited angular movement of the rollers within their housing 42**.

At the precise point at which the rollers initially contact the snake, the bottom of the set screw 102 which has been threadably positioned within drive member 90 will move into contact with the top surface **94*a* (FIG. 10) of member 94 preventing any further rotation of handle 90*a*. With the parts in this position, and without any downward pressure being exerted on the lever handle 90*a*, rotation of the snake 16 will impart no rotation to the rollers 40**. Rather, the snake will simply "thread" through the rollers at a rate of speed of on the order of five feet per minute.

Downward pressure on the lever handle **90*a* causing it to move to the full down position shown in FIG. 12 will cause the cam surfaces 90*c* to move the collar 92 downwardly in turn causing compression of spring 110. At the maximum down position of the lever handle there exists maximum pressural engagement of the rollers 40 against the snake 15. At such maximum roller pressure, due to the increased lead angle of the roller groove as previously described, the snake 16** will feed at a rate of about twenty feet per minute. At intermediate positions of the lever handle, the rate of feed of the snake will vary between five and twenty feet per minute. Accordingly, by merely adjusting the amount of downward pressure exerted on the lever handle, the operator can precisely regulate the rate of feed of the snake into the line.

In the event a restriction in the line is encountered or in the event undue torque builds up in the spring, the operator can immediately release the lever handle and apply both hands to the spring guide to steady the torque conditions between the line opening and the tool. At the precise instant the operator releases the lever handle the feed will automatically reduce to the five feet per minute slow feed. In the event the torque condition continues to build, the tension on spring 110 is such that the feed rollers can automatically separate slightly and move completely out of driving engagement with the snake causing the rate of feed of the snake to immediately reach zero. This feature, which is also inherent in the previously discussed embodiments, prevents damage to the snake and more importantly guards against injury to the operator.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A spring feeding mechanism for use with plumbing tools of the type having an elongated coiled spring wire, or plumber's snake and means for rotating the snake about its longitudinal axis, comprising:

(a) snake engaging means movable into and out of driving engagement with the snake for feeding the snake axially of itself; said means comprising:

(1) first and second hingeably interconnected jaws movable from a first open position to a second closed position proximate the snake;

(2) a pair of feed rollers, rotatably carried by said second jaw;

(3) at least one feed roller rotatably carried by said first jaw, each of said feed rollers being adapted to rotate about an axis disposed at an angle with respect to the longitudinal axis of the snake and each having helical grooves formed therein adapted to operably engage the coils of the snake when said jaws are in said second position so as to urge axial movement of said snake relative to said feed rollers; and (b) latching means operably coupled with said snake engaging means for moving said first and second jaws from said first position to said second position and for latching saw jaws together in said second closed position, said means including biasing means for yieldably urging against separation of said jaws while at the same time being responsive to forces opposing axial feeding of the snake so that said feed rollers will automatically move out of driving engagement with the snake in response to such forces.

2. A spring feeding mechanism as defined in claim 1 in which said latching means comprises:

(a) an elongated member pivotally connected proximate one end thereof to one of said first and second jaws;

(b) engaging means carried by said elongated member for axial movement with respect thereto, said engaging means being adapted to lockably engage said other of said first and second jaws when said jaws are in said second position;

(c) adjustment means carried by said elongated member proximate the free end thereof for adjusting the force exerted by said biasing means in urging against separation of said jaws.

3. A spring feeding mechanism as defined in claim 2 in which said biasing means comprises an elongated coil spring received over said elongated member, one end of said coil spring being adapted to operably engage said engaging means and the other end being adapted to operably engage said adjustment means.

4. A spring feeding mechanism as defined in claim 3 in which said adjustment means comprises a handle threadably connected to said elongated member.

5. A spring feeding mechanism as defined in claim 1 in which said snake engaging means further comprises roller positioning means for positioning said rollers within said jaws, said means comprising a roller housing and an axle member carried by said housing about which said roller rotates, said axle member being adapted for limited movement within said housing whereby when said jaws are in said closed position said rollers can adjust to the angular orientation of the coils of the snake.

6. A spring feeding mechanism as defined in claim 5 in which said second jaw is provided with a pair of spaced apart openings each of which is adapted to removably receive one of said roller positioning means and in which said first jaw is provided with a centrally disposed opening adapted to removably receive one of said roller positioning means.

7. A spring feeding mechanism for use with plumbing tools of the type having an elongated coiled spring wire, or plumber's snake and means for rotating the snake about its longitudinal axis, comprising:

(a) first and second jaws hingeably interconnected at one end and having mating portions located proximate their free ends, each of said jaws having at least one recessed opening formed therein intermediate its ends;

(b) a feed roller assembly removably receivable in each of said recessed openings in said jaws, each said roller assembly comprising:

(1) a helically grooved roller;

(2) a housing adapted to house said roller; and (3) an axle supported within said housing adapted to rotatably support said roller for rotating about an axis disposed at an angle with respect to the longitudinal axis of the snake; and (c) latching means for moving said first and second jaws from a first open position wherein said mating portions are spaced apart to a second closed position wherein said mating portions are in close proximity and for latching said jaws together in said second closed position, said means including biasing means for yieldably urging against separation of said mating portions while at the same time being responsive to forces opposing axial feeding of the snake so that said feed rollers will automatically move out of driving engagement with the snake in response to such forces.

8. A spring feeding mechanism as defined in claim 7 in which said latching means comprises:

(a) an alongated member pivotally connected proximate one end thereof to said free end of one of said first and second jaws;

(b) an elongated coil spring receivable over said elongated member;

(c) a collar associated with said elongated member for axial movement with respect thereto; and (d) adjustment means connected to said elongated member to compress said coil spring against said collar.

9. A spring feeding mechanism as defined in claim 8 in which said free end of said other of said first and second jaws is provided with a slot adapted to receive said elongated member, whereby when said jaws are in a closed position said elongated member is receivable in said slot to bring said collar into pressural engagement with said one of said first and second jaws.

10. A spring feeding mechanism for use with plumbing tools of the type having an elongated coiled spring wire, or plumber's snake and means for rotating the snake about its longitudinal axis, comprising:

(a) first and second jaws hingeably interconnected at one end and having mating portions located proximate their free ends, one of said mating portions having a slot formed therein and each of said jaws having at least one recessed opening formed therein intermediate its ends;

(b) a feed roller assembly removably receivable in each of said recessed openings in said jaws, each said feed roller assembly comprising:

(1) a helically grooved roller;

(2) a housing adapted to house said roller; and (3) an axle supported within said housing adapted to rotatably support said roller for rotation about an axis disposed at an angle with respect to the longitudinal axis of the snake; and (c) latching means for moving said first and second jaws from a first open position wherein said mating portions are spaced apart to a second closed position wherein said mating portions are in close proximity and for latching said jaws together in said second closed position, said latching means comprising:

(1) an elongated member pivotally connected proximate one end thereof to said free end of one of said first and second jaws, said member being receivable in said slot formed in said other of said first and second jaws when said jaws are in a closed position;

(2) an elongated coil spring receivable over said elongated member;

(3) a collar receivable over said elongated member, said collar being interconnected with said coil spring and being movable axially along said elongated member; and (4) adjustment means connected to said elongated member for compressing said coil spring against said collar.

11. A spring feeding mechanism for use with plumbing tools of the type having an elongated coiled spring wire, or plumber's snake and means for rotating the snake about its longitudinal axis, comprising:

(a) snake engaging means movable into and out of driving engagement with the snake for feeding the snake axially of itself; said means comprising:

(1) first and second hingeably interconnected jaws movable from a first open position to a second closed position proximate the snake;

(2) a pair of feed rollers, rotatably carried by said second jaw;

(3) at least one feed roller rotatably carried by said first jaw, each of said feed rollers being adapted to rotate about an axis disposed at an angle with respect to the longitudinal axis of the snake and each having helical grooves formed therein adapted to operably engage the coils of the snake when said jaws are in said second position so as to urge axial movement of said snake relative to said feed rollers; and (b) latching means operably coupled with said snake engaging means for moving said first and second jaws from said first position to said second position and for latching said jaws together in said second closed position, said latching means including:

(1) an elongated member pivotally connected proximate one end thereof to said free end of one of said first and second jaws, said member being receivable in said slot formed in said other of said first and second jaws when said jaws are in a closed position;

(2) a lower collar receivable over said elongated member said collar having an upper and lower surface and being movable axially of said member;

(3) an upper collar receivable over said elongated member, said collar having an upper and lower surface and being movable axially of said member;

(4) biasing means disposed intermediate said upper and lower collars for urging separation therebetween; and (5) actuating means for urging said upper collar toward said lower collar against the urging of said biasing means.

12. A spring feeding mechanism as defined in claim 11 in which said actuating means comprises:

(a) an elongated lever handle; and (b) cam means associated with said lever handle for engaging the upper surface of said upper collar upon vertical movement of said lever handle to impart movement to said upper collar in a direction toward said lower collar.

13. A spring feeding mechanism as defined in claim 12 in which said actuating means further comprises an internally threaded member rotatable with said lever handle and adapted to be threadably received over said elongated member upon rotation of said lever handle.

14. A spring feeding mechanism as defined in claim 13 in which said actuating means further includes stop means for limiting the degree of rotation of said internally threaded member relative to said elongated member.

* * * * *